US007488213B2

(12) United States Patent
Plummer

(10) Patent No.: US 7,488,213 B2
(45) Date of Patent: Feb. 10, 2009

(54) FUSE HOLDER ASSEMBLY

(75) Inventor: Lew Plummer, Mount Vernon, WA (US)

(73) Assignee: PACCAR Inc., Bellevue, WA (US)

( * ) Notice: Subject to any disclaimer, the term of this patent is extended or adjusted under 35 U.S.C. 154(b) by 0 days.

(21) Appl. No.: 11/694,735

(22) Filed: Mar. 30, 2007

(65) Prior Publication Data

US 2008/0239694 A1 Oct. 2, 2008

(51) Int. Cl.
*H01R 13/68* (2006.01)

(52) U.S. Cl. ..... 439/620.33; 439/777

(58) Field of Classification Search ..... 439/620.33, 439/620.26, 620.27, 620.29, 830, 883, 777
See application file for complete search history.

(56) References Cited

U.S. PATENT DOCUMENTS

| | | | | |
|---|---|---|---|---|
| 1,414,676 | A | | 5/1922 | Starrett |
| 1,483,692 | A | | 2/1924 | Stoneman |
| 1,605,163 | A | | 11/1926 | Brady |
| 1,965,181 | A | | 7/1934 | Gerlach |
| 4,531,806 | A | | 7/1985 | Hsieh |
| 4,538,879 | A | | 9/1985 | Wagener |
| 4,560,227 | A | * | 12/1985 | Bukala ..... 439/557 |
| 4,842,534 | A | | 6/1989 | Mobley |
| 6,030,257 | A | * | 2/2000 | Furuya ..... 439/620.26 |
| 6,162,098 | A | | 12/2000 | Cheng |
| 6,165,020 | A | | 12/2000 | Cheng |
| 2004/0018417 | A1 | | 1/2004 | Stack |

* cited by examiner

*Primary Examiner*—Javaid Nasri
(74) *Attorney, Agent, or Firm*—Christensen O'Connor Johnson Kindness PLLC

(57) ABSTRACT

A fuse holder assembly for a vehicle generally includes an insulator configured for supporting a circuit lead terminal and insulating the circuit lead terminal from a bus bar. The insulator includes a fuse receiver, wherein the fuse receiver is configured to releasably receive a fuse.

17 Claims, 8 Drawing Sheets

FUSE HOLDER ASSEMBLY

TECHNICAL FIELD

The present disclosure relates generally to fuse holder assemblies for vehicles, which are attachable to vehicle bus bars.

BACKGROUND

Bus bars for electrical distribution are currently used in many commercial and recreational vehicles, including trucks, buses, ships, boats, etc. In conjunction with these bus bars, inline fuse holders are typically employed to provide circuit branch protection. Conventional inline fuse holders generally require at least two crimps, one at the terminal contact and one at the fuse holder, typically using crimped butt splices. Such crimping is inefficient and increases circuit line losses reducing electrical efficiency.

Therefore, there exists a need for an improved inline fuse holder that reduces the number of mechanical connections to reduce costs associated with assembly and maintenance and to improve electrical efficiency.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a fuse holder assembly for a vehicle is provided. The fuse holder assembly includes an insulator configured for supporting a circuit lead terminal and insulating the circuit lead terminal from a bus bar. The insulator includes a fuse receiver, wherein the fuse receiver is configured to releasably receive a fuse.

In accordance with another embodiment of the present disclosure, a fuse holder assembly for a vehicle is provided. The fuse holder assembly includes an insulation block configured for supporting a circuit lead terminal and insulating the circuit lead terminal from a bus bar. The insulation block includes a fuse receiver, the fuse receiver being configured to releasably receive a fuse.

In accordance with yet another embodiment of the present disclosure, a fuse holder assembly for a vehicle is provided. The fuse holder assembly includes an insulator supporting a circuit lead terminal and capable of insulating the circuit lead terminal from a bus bar. The insulator includes a fuse receiver, the fuse receiver being configured to releasably receive a fuse. The fuse holder assembly provides an electrical connection between the bus bar and the circuit lead via the fuse.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Figure 1:
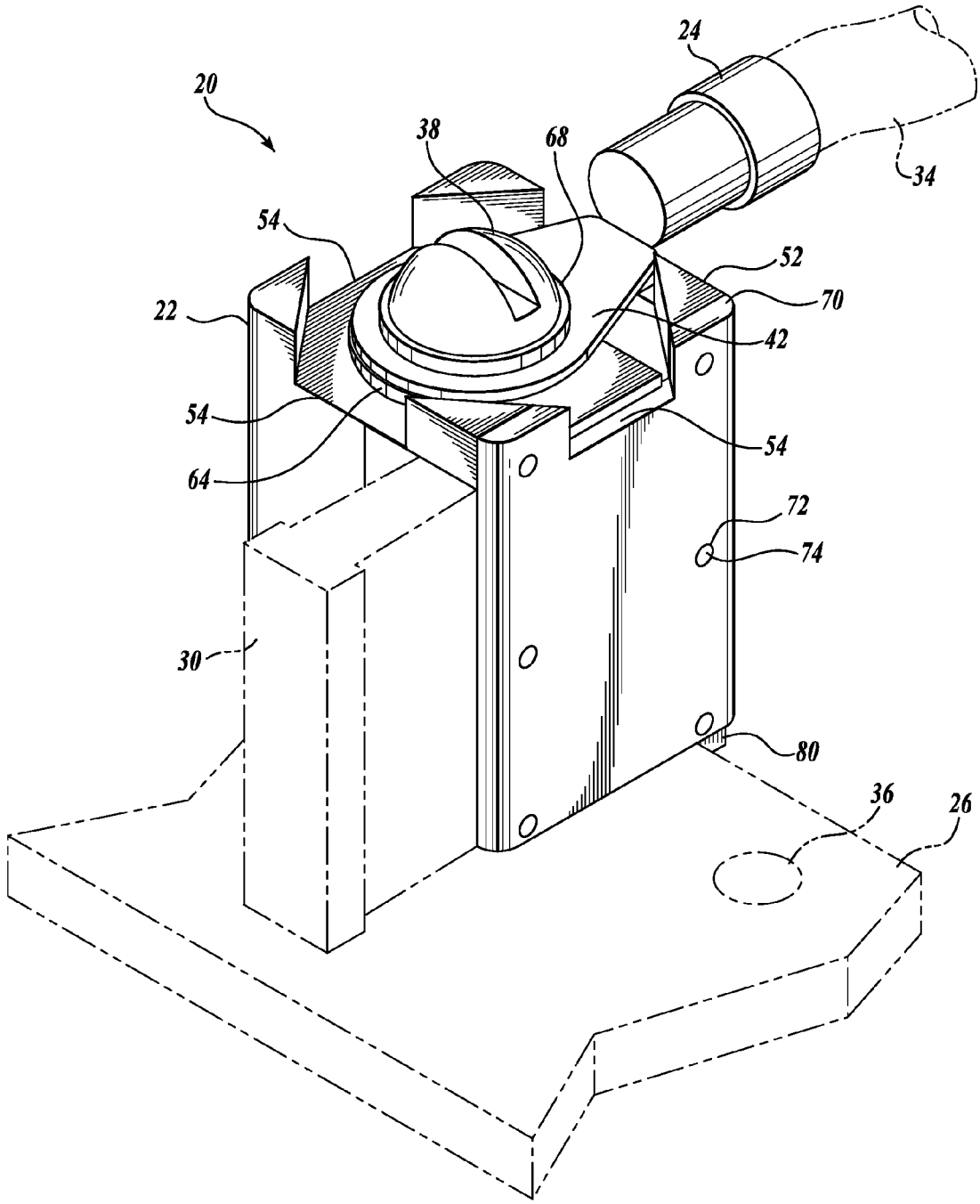
FIG. 1 is a perspective view of a fuse holder assembly for a vehicle constructed in accordance with one embodiment of the present disclosure.

Embodiments of the present disclosure are generally directed to fuse holder assemblies for vehicles. A fuse holder assembly 20 for a vehicle constructed in accordance with one embodiment of the present disclosure may be best understood by referring to FIGS. 1-3. The fuse holder assembly 20 includes an insulator 22 configured for supporting a circuit lead terminal 24 and insulating the circuit lead terminal 24 from a bus bar 26. The insulator 22 includes a fuse receiver 28, wherein the fuse receiver 28 is configured to releasably receive a fuse 30 (see FIG. 2).

Fuse holder assemblies in accordance with the embodiments described herein are configured to be attachable to vehicle bus bars. As a nonlimiting example, referring to FIG. 4, a plurality of fuse holder assemblies 20 are attached to a bus bar 26. The bus bar 26 is suitably a plate of conductive material, such as copper or copper alloy, through which an electric current may travel. The bus bar 26 may include a plurality of holes 36 configured for receiving a mounting device 38 for attaching the fuse holder assembly to the bus bar 26, such as a mounting bolt or screw (see FIG. 3). As described in greater detail below, when in use, an electrical power source (not shown) is connected to the bus bar 26 to provide an electric current through the bus bar 26.

In accordance with the embodiments described herein, the fuse holder assembly 20 provides a means for electrical connection between a powered bus bar 26 and a circuit lead 34 via a fuse 30, such as a standard blade fuse. Referring to FIG. 1, a circuit lead 34 is releasably attachable to the circuit lead terminal 24. Such attachment may be by crimping the circuit lead 34 to the circuit lead terminal 24.

Returning to FIGS. 1-3, the insulator 22 is a block-shaped body having a center bore 50 for receiving the mounting device 38. It should be appreciated, however, that other bodies beside block-shaped bodies are within the scope of the present disclosure. For example, the insulator may be any three-dimensional space figure.

The insulator 22 is suitably formed from a nonconductive material to provide insulation. In addition, the insulator 22 provides support for the fuse receiver 28 so that it is properly positioned and insulated from the circuit lead terminal 24 and the bus bar 26 to support a fuse 30. In this regard, referring to FIG. 2, the height of the insulator 22 provides proper distancing between the first and second fuse clips 60 and 62 of the fuse receiver 28, which, as described in detail below, are designed and configured to releasably receive a fuse 30.

As will be discussed in greater detail, various components of the fuse holder assembly 20 include ring attachments, which are concentric and in alignment with the center bore 50 of the insulator 22 for receiving a mounting device 38. As a nonlimiting example, the circuit lead terminal 24 includes a circuit lead terminal ring 42 for receiving mounting device 38.

Figure 2:
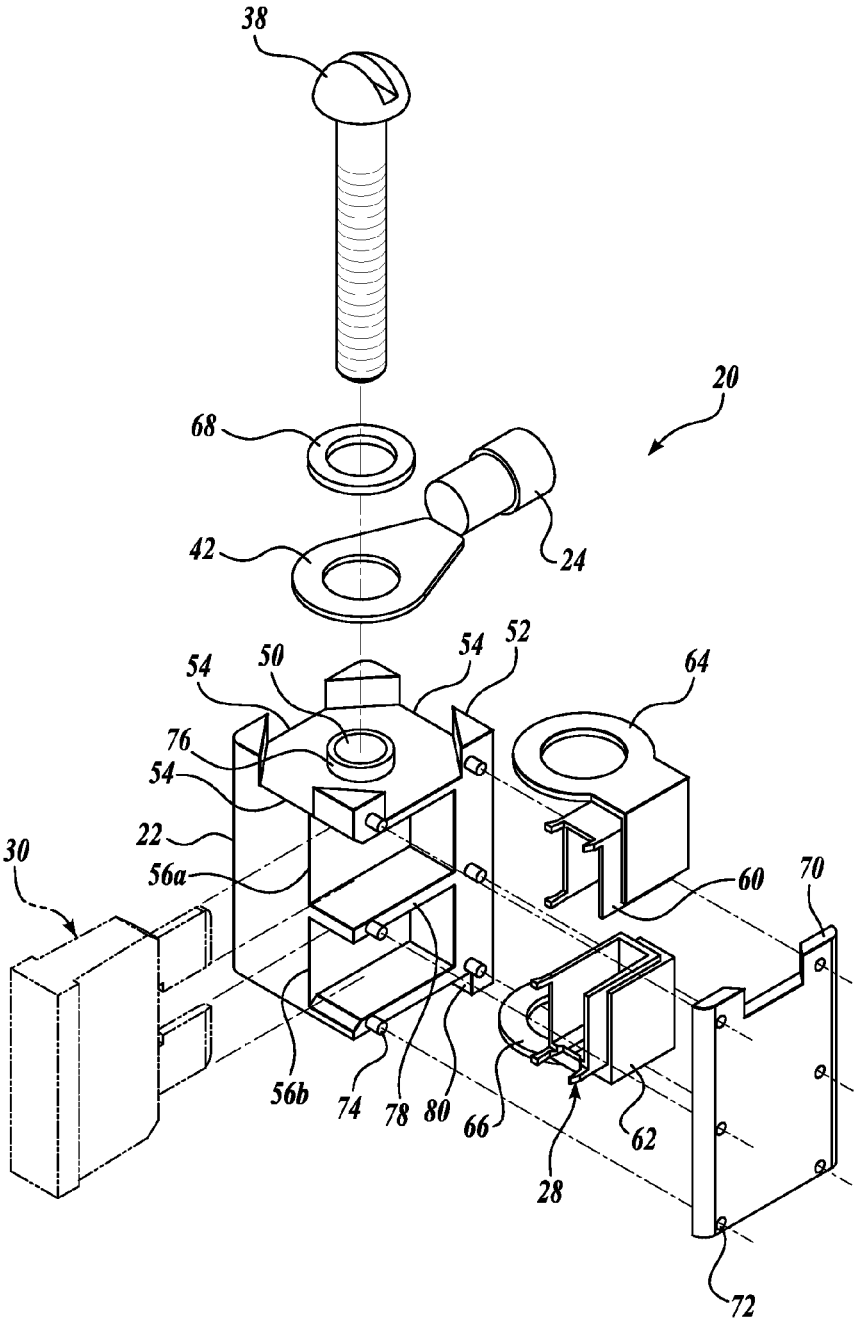
FIG. 2 is an exploded view of the fuse holder assembly of FIG. 1.

The insulator 22 further includes a crown 52 having a plurality of detents 54 and a protrusion 76 extending outwardly from the perimeter of the center bore 50 (see FIG. 2). As described in greater detail below, the protrusion 76 insulates the fuse receiver 28 and circuit lead terminal 24 from a conductive mounting device 38.

The detents 54 on the crown 52 are designed and configured to maintain the circuit lead terminal 24 in a specific orientation on the crown 52 such that the circuit lead terminal 24 does not rotate relative to the insulator 22, for example, to loosen the connection of the mounting device 38 to the insulator 22 or to otherwise interfere with other circuit lead connections or fuse holder assemblies mounted on the bus bar 26.

Multiple detents 54 allow for positioning the circuit lead terminal 24 in a plurality of orientations on the insulator 22. As a nonlimiting example, as seen in the illustrated configuration of FIG. 4, two adjacent fuse holder assemblies 20 are coupled to the bus bar 26. In this configuration, both circuit lead terminals 32 are positioned in the same orientation on their respective insulators 22. However, each of the circuit lead terminals 32 are repositionable into two other orientations on each insulator 22, in accordance with the other available detents. In this configuration, due to the close proximity of the adjacent fuse holder assemblies 20, neither circuit lead terminal 24 is positionable in the direction of the adjacent fuse holder assembly 20.

It should be appreciated that when only one fuse holder assembly 20 is attached to the bus bar 26 (for example, see FIG. 1), or when adjacent fuse holder assemblies 20 are sufficiently spaced from one another, the circuit lead terminal 24 may be positionable in at least four different orientations. It should further be appreciated that while four detents (corresponding to four different orientations for the circuit lead terminal 24) are shown in the illustrated embodiment of FIGS. 1-4, any number of detents (including zero detents), and their respective orientations, are within the scope of the present disclosure.

As mentioned above, the fuse receiver 28 includes first and second fuse clips 60 and 62, each having first and second fuse clip rings 64 and 66. The first and second fuse clips 60 and 62 are suitably disposed within the insulator 22 in side channels 56*a* and 56*b*, respectively, with one fuse clip disposed in each side channel. During assembly, side panel 70 can be removed from the insulator 22 to provide access to the side channels 56*a* and 56*b*. When the side panel 70 is removed, each of the first and second fuse clips 60 and 62 can be inserted into respective side channels 56*a* and 56*b* with fuse clip rings 64 and 66 extending, respectively, outwardly up and down from the side channels 56*a* and 56*b* to be in alignment with the center bore 50 and the respective top and bottom surfaces of the insulator 22.

After being disposed within the side channels 56*a* and 56*b*, the first and second fuse clips 60 and 62 are maintained within the insulator 22 by the side panel 70, which is designed and configured to couple with the main body of the insulator 22. In that regard, the plate 70 includes a plurality of holes 72, which are designed and configured to interconnect with protrusions 74 by an interference fit. Although the holes 72 and protrusions 74 are designed for an interference fit in the illustrated embodiment, it should be appreciated that other connection means for the side panel 70 and the insulator 22 are within the scope of the present disclosure, including adhesive, welding, and other suitable coupling or fastening devices.

Figure 3:
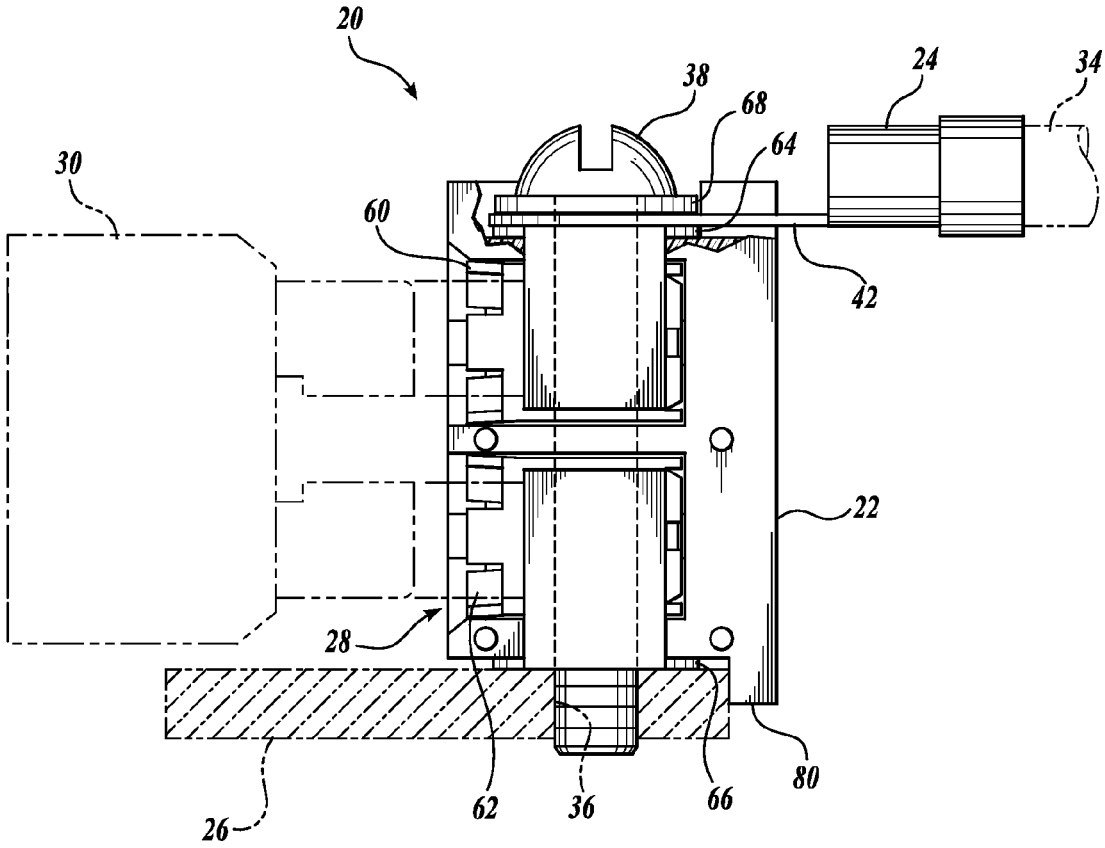
FIG. 3 is a partial cutaway view of the fuse holder assembly of FIG. 1.

As best seen in FIGS. 2 and 3, the first and second fuse clips 60 are spaced from one another so as to not be electrically connected to one another. As best seen in FIG. 2, the first and second fuse clips 60 can be separated by nonconductive insulation, such as an insulative divider 78 between the side channels 56*a* and 56*b*. As discussed in greater detail below, only when a fuse 30 is inserted in the fuse receiver 28 is an electrical connection achieved between the conductive first and second fuse clips 60 and 62.

While fuse clips 60 and 62 and fuse clip rings 64 and 66 are seen in the illustrated embodiment of FIGS. 1-4 as integrally constructed elements to reduce potential temperature increases at a connection site, it should be appreciated that the fuse clips and fuse clip rings may be manufactured as discrete elements in electrical communication with one another.

Returning now to FIGS. 1-3, the first fuse clip ring 64 is electrically connected to the circuit lead terminal ring 42. In that regard, the circuit lead terminal ring 42 and the first fuse clip ring 64 are positioned adjacent and in electrical communication at the crown 52 of the insulator 22. The circuit lead terminal ring 42 and the first fuse clip ring 64 are concentric and in alignment with the center bore 50 of the insulator 22 for receiving the mounting device 38. However, both rings 42 and 64 are insulated from the mounting device 38 by insulating ring 68 (such as a washer) and insulative protrusion 76 extending outwardly from the outer perimeter of the center bore 50.

The second fuse clip ring 66 is positioned at the base of the insulator 22 adjacent the bus bar 26 and electrically connected to the bus bar 26. In the illustrated embodiment, the second fuse clip ring 66 is concentric and in alignment with the center bore 50 of the insulator 22 and a bus bar hole 36 (see FIG. 3) for receiving mounting device 38. While an insulating ring for the second fuse clip ring 66 (similar to insulation ring 68 and/or protrusion 76) is within the scope of the present disclosure, it should be appreciated that the second fuse clip ring 66 need not be insulated from the mounting device 38 like the circuit lead terminal ring 42 and the first fuse clip ring 64, as described above.

When a fuse 30 is received within the fuse receiver 28, one prong of the fuse 30 is received by the first fuse clip 60, and the second prong is received by the second fuse clip 62 to provide an electrical connection between the bus bar 26 and the circuit lead terminal 24. Through this connection, the fuse 30 provides protection from over current between the bus bar 26 and the circuit lead terminal 24 to prevent fire or damage due to overload or short circuits.

As best seen in FIG. 3, the insulator 22 further includes an anchor key 80 for anchoring the fuse holder assembly 20 to the bus bar 26, as best seen in FIG. 3. The anchor key 80 is a downwardly extending protrusion from the body of the insulator 22 which is configured to prevent the fuse holder assembly 20 from rotating relative to the bus bar 26 after the fuse holder assembly 20 is positioned on the bus bar 26. In one embodiment, the anchor key 80 is configured to have an interference fit with the side of the bus bar 26.

Connection of the circuit lead terminal 24 to the insulator 22 will now be described in greater detail. As described above, the circuit lead terminal 24 has a circuit lead terminal ring 42 configured to be concentric and in alignment with the center bore 50 of the insulator 22 for receiving mounting device 38. It should be appreciated that the mounting device 38 may be conductive or nonconductive. In the case in which the mounting device 38 is conductive, the circuit lead terminal ring 42 can be insulated from the mounting device 38 by an insulating ring 68 to prevent electric current from traveling through the mounting device 38 (for example, from the head of the mounting device) directly to the circuit lead terminal 24 via circuit lead terminal ring 42, bypassing fuse 30. The terminal ring 42 can also be insulated from the stem of the mounting device 38 by insulative protrusion 76, as described above with reference to the fuse clip ring 64.

Figure 6:
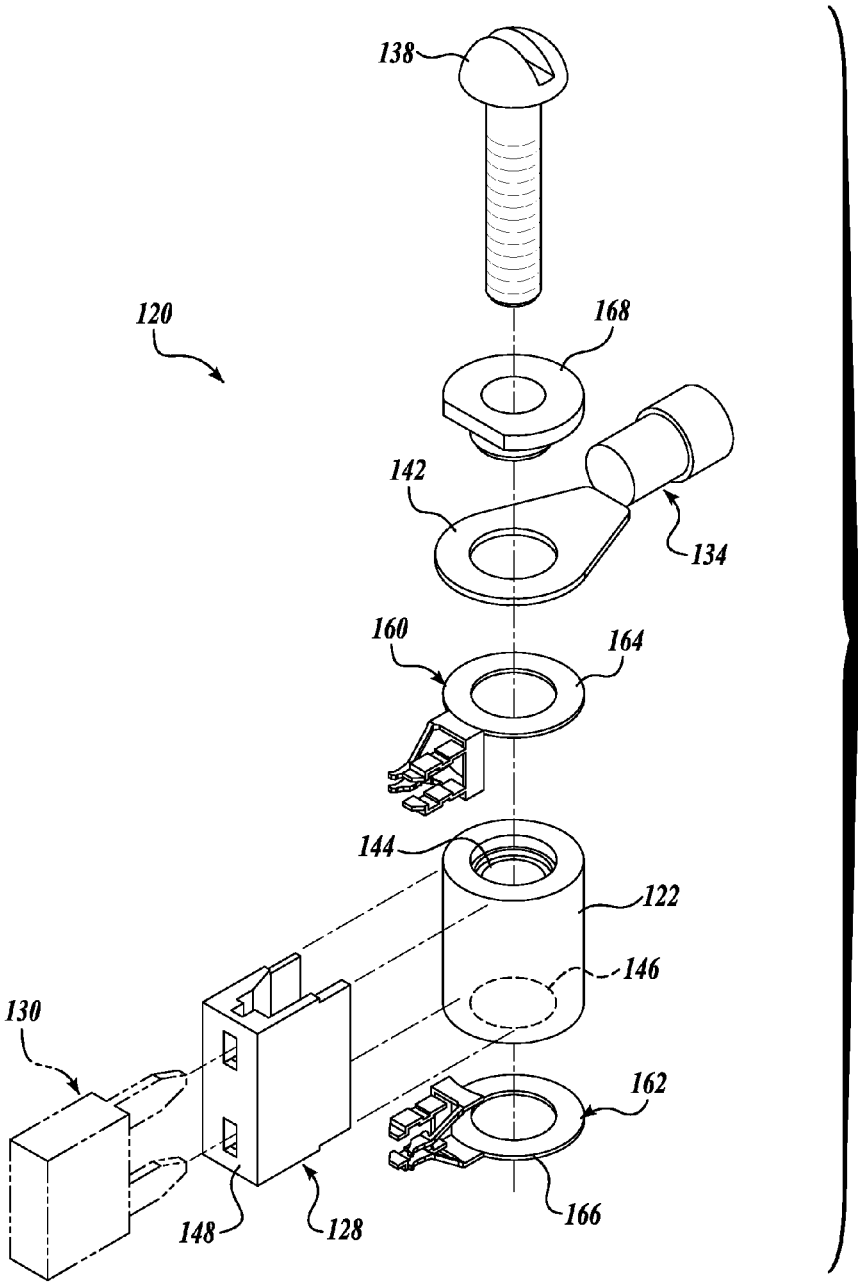
FIG. 6 is an exploded view of the fuse holder assembly of FIG. 5.
Figure 7:
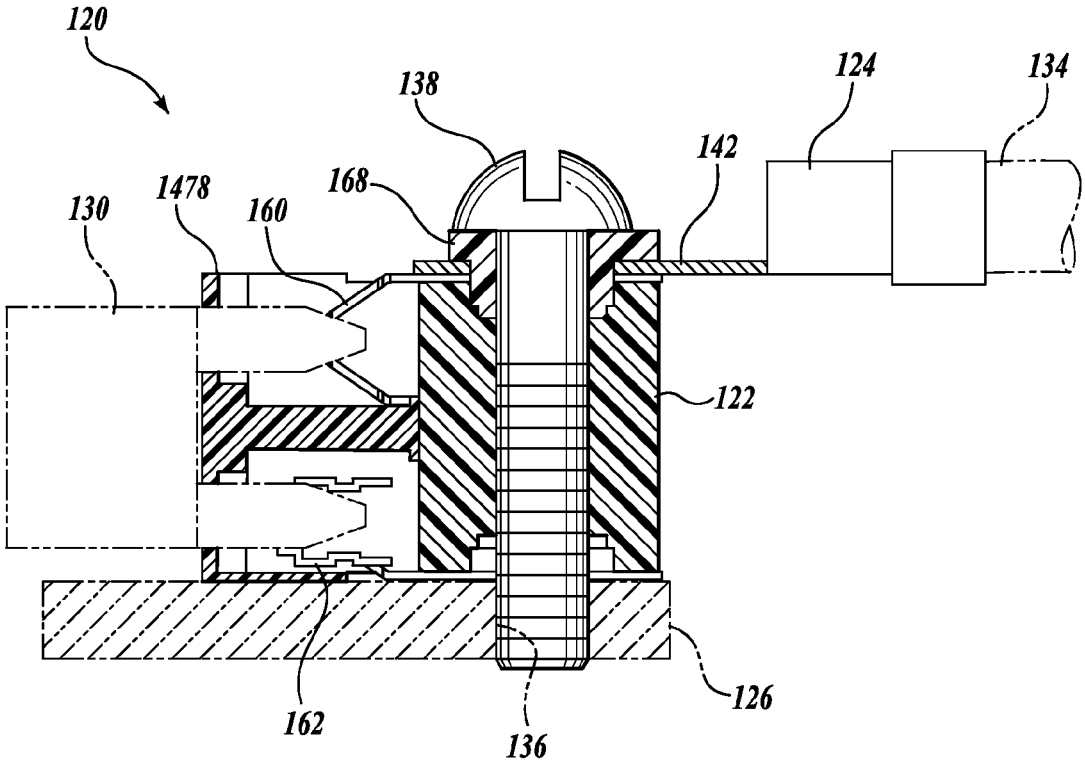
FIG. 7 is a cross-sectional view of the fuse holder assembly of FIG. 5.

In another embodiment, the insulating ring may include a cylindrical collar that rests inside the circuit lead terminal ring 42 and the first fuse clip ring 64 to provide additional insulation between the mounting device 38 and both the circuit lead terminal ring 42 and the first fuse clip ring 64 (for example, see the insulating ring 168 of FIGS. 6 and 7). It should be appreciated, however, that if the mounting device is nonconductive, such insulation between the mounting device 38 and the circuit lead terminal ring 42 is not required.

Figure 4:
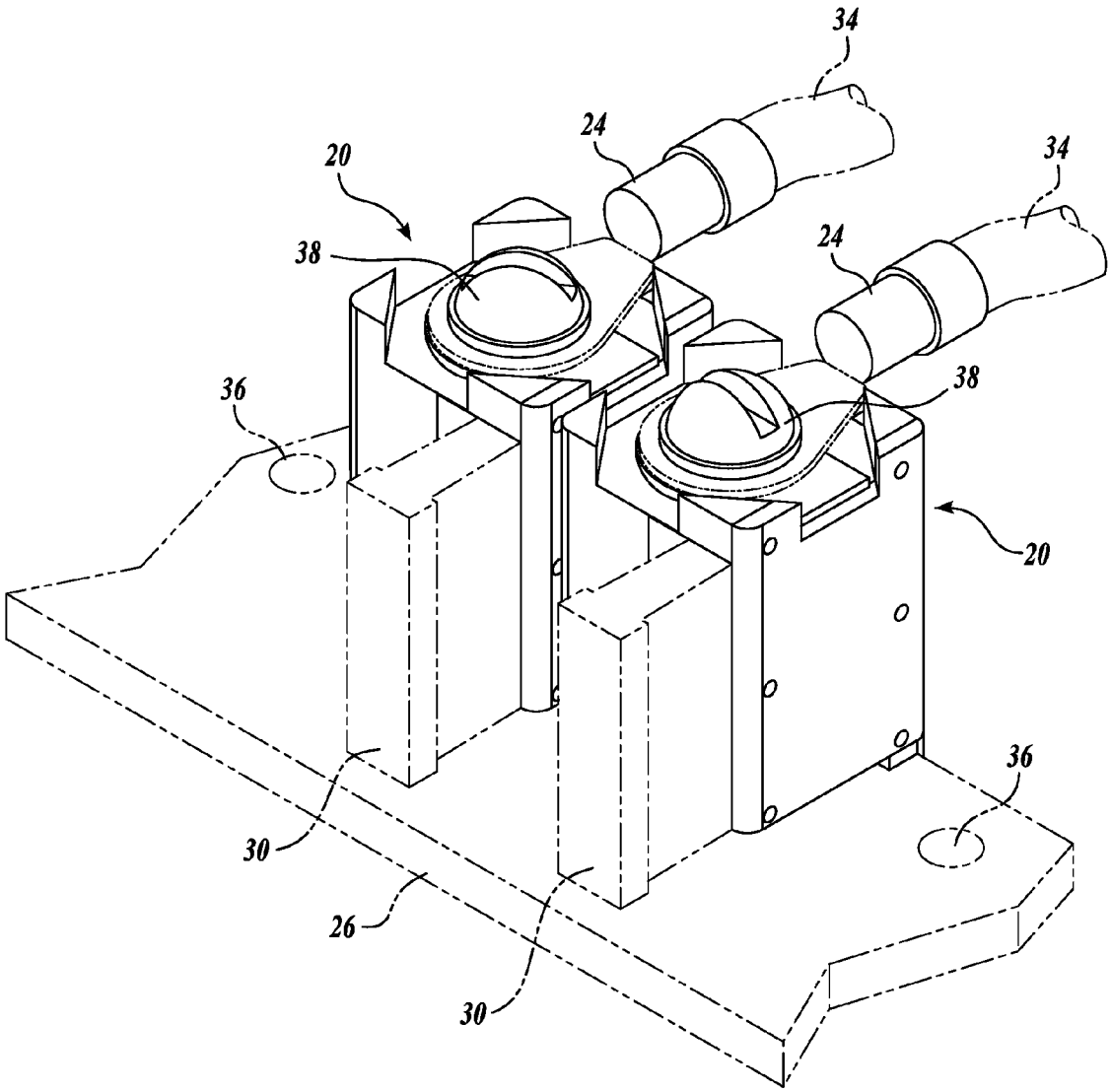
FIG. 4 is a perspective view of a plurality of fuse holder assemblies constructed in accordance with the embodiment of FIG. 1 and arranged in an inline mount on a bus bar.
Figure 5:
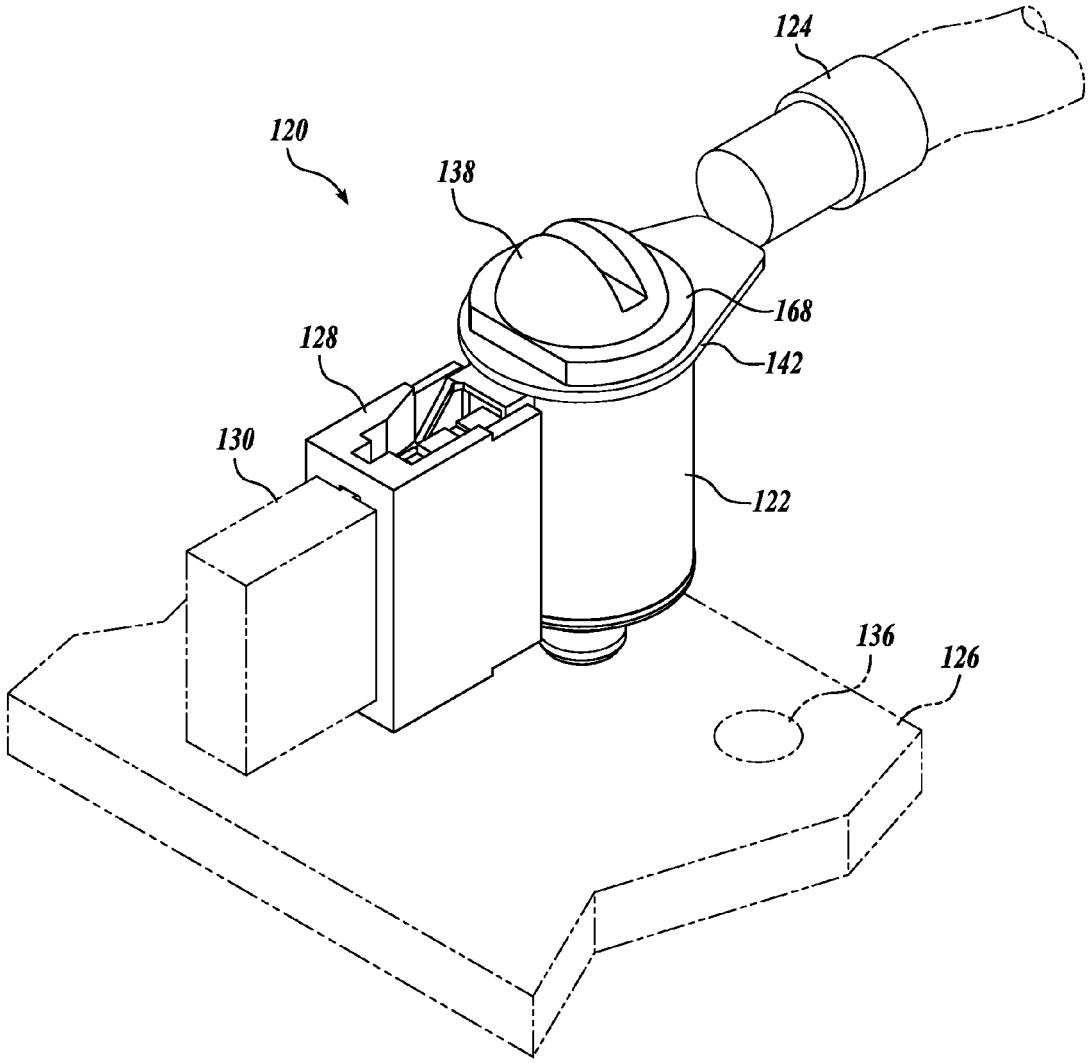
FIG. 5 is a perspective view of a fuse holder assembly for a vehicle constructed in accordance with yet another embodiment of the present disclosure.

The operation of the system will now be described with reference to FIGS. 3 and 4. As best seen in FIG. 4, one or more fuse holder assemblies 20 are attached to a bus bar 26 by mounting device 38. A fuse 30 is inserted in each of the fuse receivers 28 of the fuse holder assemblies 20, and circuit lead 34 is crimped to each of the circuit lead terminals 24 of the fuse holder assemblies 20.

When an electrical power source (not shown) is connected to the bus bar 26, electrical current runs from the power source to the bus bar 26. This current passes from the bus bar 26 to conductive second fuse clip ring 66, as best seen in the side view of FIG. 3. From the second fuse clip ring 66, current passes to the second fuse clip 62, through the fuse 30, to the first fuse clip 60, and to the first fuse clip ring 64. Current then passes from the first fuse clip ring 64 to the circuit lead terminal ring 42 and circuit lead terminal 24. As described above, insulating ring 68 and insulating protrusion 76 prevent current from running through the mounting device 38 to the circuit lead terminal ring 42 and the circuit lead terminal 24, bypassing the fuse 100.

If a fixture attached to the circuit lead 34 draws enough current to blow the fuse 30, the fuse 30 can be replaced at the fuse receiver 28, without requiring removal of the fuse holder assembly 20 from the bus bar 26 or removal of a circuit lead 34 from the circuit lead terminal 24. In addition, if a circuit lead 34 needs to be disconnected from the bus bar 26, only one crimp is disconnected from the fuse holder assembly 20 at the circuit lead terminal 24, also without requiring removal of the fuse holder assembly 20 from the bus bar 26 and without requiring removal of the fuse 30 from the fuse receiver 28.

Now referring to FIGS. 5-9, fuse holder assemblies for vehicles in accordance with other embodiments of the present disclosure will be described in greater detail. The assemblies are substantially identical in materials and operation as the previously described embodiment, except for differences regarding the insulator and the fuse receiver, which will be described in greater detail below.

For clarity in the ensuing descriptions, numeral references of like elements of the fuse holder assembly 20 are similar, but are in the 100 series for the illustrated embodiment of FIGS. 5-9.

Similar to insulator 22 described above, insulator 122 is also configured for supporting the circuit lead terminal 124 and insulating the circuit lead terminal 124 from the bus bar 126. In the illustrated embodiment of FIGS. 5-9, the insulator 122 is a cylindrically shaped body having first and second open ends 144 and 146 and a center bore 150 extending between these two ends 144 and 146 for receiving the mounting device 138 (see FIG. 6). The mounting device 138 is attachable to a bus bar 126, for example, at a bus bar hole 136 (see FIG. 5).

As best seen in FIG. 6, the fuse receiver 122, including housing 148 and first and second fuse clips 160 and 162, is positioned external to insulator 122. The insulator 122 provides support for the housing 148 and the first and second fuse clips 160 and 162 such that they are properly positioned to support a fuse 30. The housing 148 houses the first and second fuse clips 160 and 162 and is coupled to the insulator 122 adjacent the insulator 122 along the height of the cylindrical body of the insulator 122.

The first fuse clip 160 includes a first fuse clip ring 164, wherein the ring 164 is located adjacent the first open end 144 of the insulator 22. The second fuse clip 162 includes a second fuse clip ring 166, wherein the ring 166 is located adjacent the first open end 144 of the insulator 22 and the bus bar 26 at the bus bar hole 36. Therefore, the second fuse clip ring 166 is electrically connected to the bus bar 26 when the bus bar 26 is powered.

Figure 8:
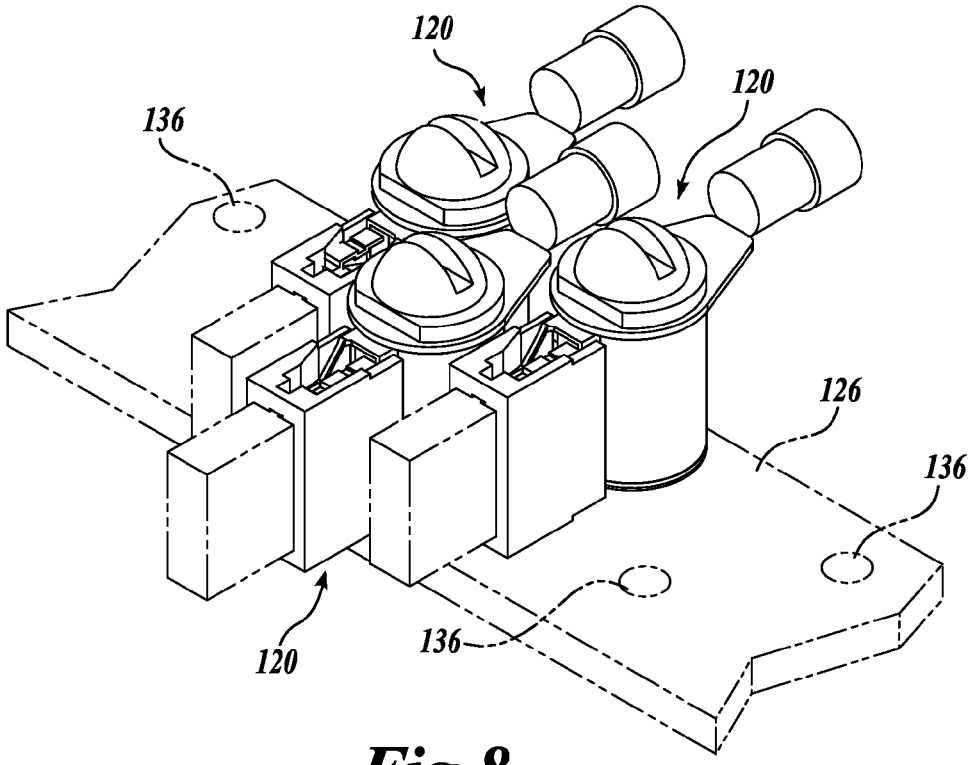
FIG. 8 is a perspective view of a plurality of fuse holder assemblies constructed in accordance with the embodiment of FIG. 5 and arranged in a staggered mount on a bus bar.
Figure 9:
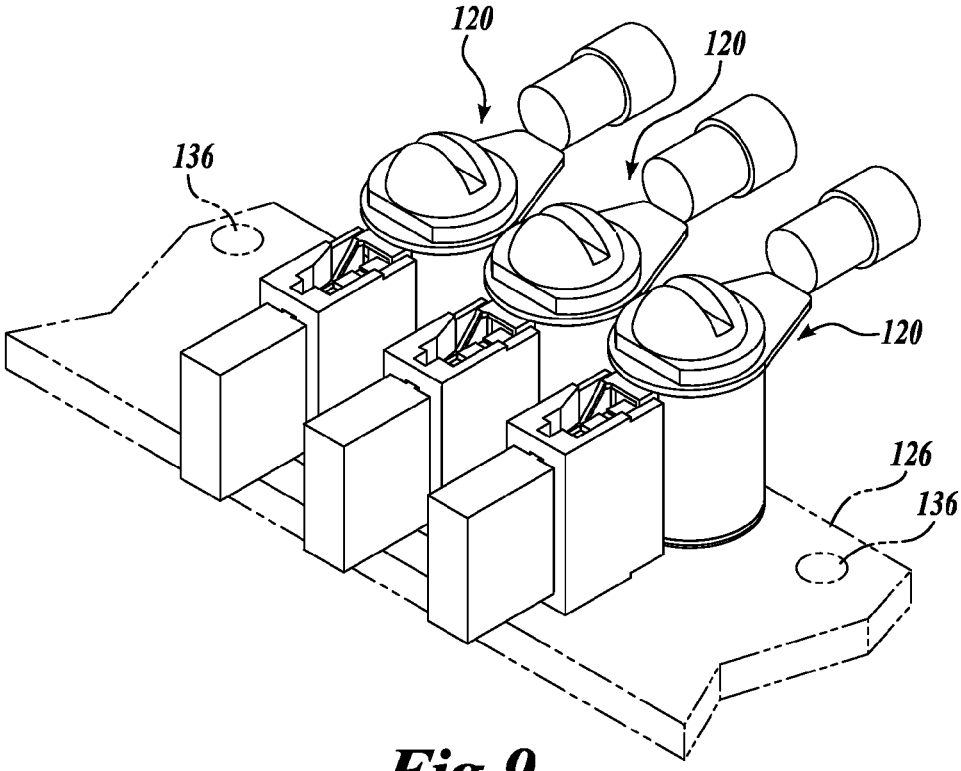
FIG. 9 is a perspective view of a plurality of fuse holder assemblies constructed in accordance with the embodiment of FIG. 5 and arranged in an inline mount on a bus bar.

Referring to FIGS. 8 and 9, the shape of the insulator 122 provides for different orientations of a plurality of fuse holder assemblies 120 on a bus bar. As nonlimiting examples, a plurality of fuse holder assemblies 120 can be arranged in a staggered mount (see FIG. 8) or an inline mount (see FIG. 9) on bus bars 126.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. While illustrative embodiments have been illustrated and described, it will be appreciated that various changes can be made therein without departing from the spirit and scope of the disclosure.

The invention claimed is:

1. A fuse holder assembly for a vehicle, the fuse holder assembly comprising:

an insulator configured for supporting a circuit lead terminal and insulating the circuit lead terminal from a bus bar, the insulator including a fuse receiver, wherein the fuse receiver is configured to releasably receive a fuse, wherein the insulator further includes a crown and wherein the circuit lead terminal is positionable to extend from the perimeter of the crown in a plurality of different directions.

2. The fuse holder assembly of claim 1, wherein the insulator includes an anchor key to prevent rotation of the insulator relative to the bus bar after the insulator is positioned on the bus bar.

3. The fuse holder assembly of claim 1, wherein the insulator includes a channel for receiving the fuse receiver.

4. The fuse holder assembly of claim 1, wherein the insulator includes a bore for receiving a mounting device for coupling the fuse holder assembly to the bus bar.

5. The fuse holder assembly of claim 1, wherein the fuse receiver includes first and second fuse clips, the first and second fuse clips being discrete and unconnected from one another, wherein the first fuse clip has an electrical connection with the circuit lead terminal and the second fuse clip has an electrical connection with the bus bar, and wherein the fuse, when received, provides an electrical connection between the first fuse clip and the second fuse clip.

6. The fuse holder assembly of claim 1, wherein the circuit lead terminal includes a terminal ring for receiving a mounting device and an insulating ring for providing insulation between the terminal ring and the mounting device.

7. The fuse holder assembly of claim 1, wherein the fuse is a standard blade fuse.

8. The fuse holder assembly of claim 1, wherein the fuse receiver is disposed within the insulator.

9. The fuse holder assembly of claim 1, wherein the insulator is an insulation block.

10. A fuse holder assembly for a vehicle, the fuse holder assembly comprising:

an insulator configured for supporting a circuit lead terminal and insulating the circuit lead terminal from a bus bar, the insulator including a fuse receiver, wherein the fuse receiver is configured to releasably receive a fuse, wherein the insulator further includes a crown having a plurality of detents for positioning the circuit lead terminal in a plurality of orientations on the insulator.

11. A fuse holder assembly for a vehicle, the fuse holder assembly comprising:

an insulator supporting a circuit lead terminal and capable of insulating the circuit lead terminal from a bus bar, wherein the insulator includes a fuse receiver, the fuse receiver configured to releasably receive a fuse, the fuse holder assembly providing an electrical connection between the bus bar and the circuit lead via the fuse, wherein the insulator further includes a crown and wherein the circuit lead terminal is positionable in a plurality of locations around the perimeter of the crown.

12. The fuse holder assembly of claim 11, wherein the crown has a plurality of detents for positioning the circuit lead terminal in a plurality of locations on the insulator.

13. A fuse holder assembly for a vehicle, the fuse holder assembly comprising:

a circuit lead terminal for receiving a circuit lead;

an insulator configured for supporting the circuit lead terminal and insulating the circuit lead terminal from a bus bar, the insulator including a fuse receiver configured to releasably receive a fuse, the insulator further including a bore for receiving a mounting device for coupling the assembly to the bus bar, the assembly configured such that either of the fuse and the circuit lead can be coupled to or decoupled from the assembly without decoupling the other of the fuse and the circuit lead.

14. The fuse holder assembly of claim 13, wherein the circuit lead terminal includes a terminal ring for receiving the mounting device, and wherein the circuit lead terminal includes an insulating ring for providing insulation between the terminal ring and the mounting device.

15. The fuse holder assembly of claim 13, wherein the fuse receiver includes first and second fuse clips, the first and second fuse clips being discrete and unconnected from one another, wherein the first fuse clip has an electrical connection with the circuit lead terminal and the second fuse clip has an electrical connection with the bus bar, and wherein the fuse, when received, provides an electrical connection between the first fuse clip and the second fuse clip.

16. The fuse holder assembly of claim 15, wherein the first and second fuse clips include first and second fuse clip rings for receiving the mounting device.

17. A fuse holder assembly for a vehicle, the fuse holder assembly comprising:

an insulator configured for supporting a circuit lead terminal and insulating the circuit lead terminal from a bus bar, the insulator including a fuse receiver, wherein the fuse receiver is configured to releasably receive a fuse, wherein the insulator further includes a crown and wherein the circuit lead terminal is positionable in a plurality of orientations around the perimeter of the crown, wherein the crown has a plurality of detents for positioning the circuit lead terminal in a plurality of orientations on the insulator.

* * * * *